US006983496B1

(12) United States Patent
Hernández

(10) Patent No.: US 6,983,496 B1
(45) Date of Patent: Jan. 10, 2006

(54) RAMP AND RAIL SYSTEM FOR A CHILD'S CRIB OR BED

(76) Inventor: Alfred Hernández, The Loft, 106 Sage Brush, Boeme, TX (US) 78006

( * ) Notice: Subject to any disclaimer, the term of this patent is extended or adjusted under 35 U.S.C. 154(b) by 0 days.

(21) Appl. No.: 10/881,026

(22) Filed: Jun. 30, 2004

(51) Int. Cl.
*A47D 7/02* (2006.01)
*A47D 13/06* (2006.01)
*A47C 21/08* (2006.01)

(52) U.S. Cl. ..... 5/93.1; 5/100; 5/425; 5/430; 5/655

(58) Field of Classification Search ..... 5/93.1, 5/95, 99.1, 100, 424, 425, 427–430, 655, 5/658, 503.1, 507.1
See application file for complete search history.

(56) References Cited

U.S. PATENT DOCUMENTS 329,663 A 11/1885 McMurray
2,059,240 A * 11/1936 Johnston ..... 5/100
2,897,781 A * 8/1959 Olson ..... 119/496
3,122,127 A * 2/1964 Shechmeister et al. ..... 119/417
3,618,568 A * 11/1971 Breeden ..... 119/482
3,797,461 A * 3/1974 Breeden ..... 119/482
D249,403 S * 9/1978 Lamb ..... D6/383
4,178,645 A 12/1979 Cosme
4,220,119 A * 9/1980 Albright ..... 119/497
4,359,793 A * 11/1982 Hosono ..... 5/100
5,213,060 A * 5/1993 Sloan et al. ..... 119/847
5,448,965 A * 9/1995 McClure ..... 119/482
5,519,905 A 5/1996 Bernstein et al.
5,577,277 A 11/1996 Sundberg et al.
5,596,776 A 1/1997 Huang
5,611,094 A * 3/1997 D'Entremont ..... 5/424
5,640,726 A 6/1997 Fichner-Rathus
5,671,490 A 9/1997 Wu
D388,555 S * 12/1997 Lewis ..... D30/108
D391,792 S 3/1998 Scherer et al.
5,745,936 A 5/1998 Van McCutchen et al.
5,761,756 A 6/1998 Nowak et al.
5,781,945 A 7/1998 Scherer et al.
5,970,539 A * 10/1999 McDermott et al. ..... 5/98.1
6,134,731 A 10/2000 Thom et al.
6,155,970 A * 12/2000 Dykes et al. ..... 600/22
6,453,490 B1 9/2002 Cardinale
6,457,196 B1 * 10/2002 Dykes et al. ..... 5/655
6,536,372 B1 * 3/2003 Loeser ..... 119/28.5

* cited by examiner

*Primary Examiner*—Robert G. Santos
(74) *Attorney, Agent, or Firm*—Kammer Browning PLLC

(57) ABSTRACT

A system for attachment to a child's crib combining a side rail and a ramp structure that serve to prevent the child from rolling out during sleep, and at the same time provide a means for the child to climb or crawl into or out from the crib. Components include a side rail fixed to the crib at each end by removable straps or the like, and rigidly connected to a pair of legs that slide between the mattress and box spring of the crib. A generally larger ramp component extends pivotally outward and downward from the side rail component to a point in contact with the floor. Embodiments include multiple hinged components within the ramp system to allow alternate positioning of the ramp (in whole or in parts) in an extended or a collapsed configuration.

19 Claims, 13 Drawing Sheets

RAMP AND RAIL SYSTEM FOR A CHILD'S CRIB OR BED

BACKGROUND OF THE INVENTION

1. Field of the Invention

The present invention relates generally to furniture and furnishings for baby nurseries and child bedrooms. The present invention relates more specifically to a rail and ramp system for attachment to a child's crib or bed that allows intended movement by the child to and from the crib or bed.

2. Description of the Related Art

Growing children progress rapidly through the use of a sequence of furniture and furnishings designed to provide a safe and comfortable sleeping environment for the child. A baby might initially be provided with a cradle as a sleeping environment when little or no movement of the child is anticipated during the night. Very quickly, however, the child graduates into a crib as a sleeping environment before eventually moving into a child or adult sized bed. The time period over which a child might utilize a crib can vary greatly depending upon the activity level of the child. Some children remain relatively docile, with limited movement, well past the age of two. Other children, however, become quite mobile and active as early as one year old, to the extent that a standard crib environment no longer comfortably or safely accommodates them.

Many crib manufacturers recommend that at a certain age one side of the crib be either removed or lowered as the structure of the crib might accommodate. Many cribs incorporate sliding side rails that allow the side to be lowered, either temporarily for intermittent movement in and out of the crib, or permanently as the child's age and activity level might merit. Some manufacturers recommend removing the sliding front panel when the child becomes mobile enough to get his or her arms fully over the top of the panel. The reasoning behind this recommendation is that even if the child falls from the crib, it is better to fall from mattress height than to have the child scale the front panel and fall from the panel height. Unfortunately, the simple raising or lowering of a side rail does not always accommodate the needs of many children who are active at a very young age. In addition, the lowered side rail, for many cribs, often provides inadequate side rail protection for the child when sleeping at night. All too often the height above the mattress is either too high for the child to easily access the crib when awake, or too low, such that the child might roll out from the crib while sleeping at night.

Some effort has been made in the past to provide for an intermediate solution to the problem of a young but active child in a crib sleeping environment. These efforts have generally been directed at providing for removable rails that could be positioned on the side of the crib in association with the mattress, or in some cases on the side of a child's bed in association with the mattress. In general, however, these mattress stabilized rail systems have either been too short or too long for a particular crib, i.e. they either extend beyond the posts of the crib or leave a significant and often unsafe opening in the side. In addition, these temporary and removable side rails fail to address the problem of providing easy access to the bed by the child who may be very mobile, but still not very tall, while at the same time providing for the safe containment of the child during sleep. Some of these efforts in the past include the following:

U.S. Pat. No. 5,781,945, issued to Scherer et al. entitled Portable Foldable Bed Rail. This patent describes a rail with two legs intended to be slid underneath the mattress and to hingedly support an oblong rail with hinged, collapsible end sections. The patent does not, however, address the concerns associated with variations in the height of the child, and facilitating movement in and out of the crib or bed.

U.S. Pat. No. 5,761,756, issued to Nowak et al. entitled Portable Bed Rail. This patent likewise describes a rail system that includes a pair of legs hingedly attached to the rail barrier, and intended to be slid under the mattress for support. The rail barrier component between the mattress legs is comprised of rigid telescoping poles that may be extended in length. Covering these poles and forming the barrier between them is a flexible fabric cover.

U.S. Pat. No. 329,663, issued to McMurray entitled Safety Attachment for Beds and Berths. This patent describes an early design disclosing a rail system with a pair of legs intended to be slid between the mattress and box spring, and hingedly supporting a rail on the side of the bed. The system includes a lower section that adds to the stability of the rail by insertion into a lower side support rail of the bed frame. A standard set of parallel slats form the rail barrier.

U.S. Pat. No. 4,178,645, issued to Cosme entitled Safety Bed. This patent describes a bed rail system having a pair of support legs inserted between the mattresses of the bed and being distinguished by a fold-down front rail structure. The generally tubular frame provides hinges at each end of the rail system that allow the usually upright rail to be folded down into a fully lowered and flat position against the side of the bed. Suitable locking mechanisms for maintaining the rail in an upright position are described. The complete disengagement of the rail from the leg components is also anticipated.

U.S. Pat. No. 5,596,776, issued to Huang entitled Collapsible Safeguard Rail Structure. This patent describes an assembly of tubular sections and hinged joints that provide a completely collapsing side rail for a bed. A pair of under-mattress legs is provided at each end, which supports an upright assembly of rail tubes. A midpoint in the rail system is likewise provided with hinged joints, which permit the rail not only to be folded against the mattress legs, but also to fold in half for compact storage.

U.S. Pat. No. 5,745,936, issued to Van McCutchen et al. entitled Safety Bed with Dual Purpose Side Panels. This patent describes an entire bed structure with side panel barriers extending along the entire length of the bed. The barriers are pivotally attached to a side component of the bed along its entire length. The patent anticipates raised, lowered, and intermediate positions for the side panels.

U.S. Pat. No. 5,671,490, issued to Wu entitled Collapsible Bed Rail Structure. This patent describes yet another collapsible rail system that incorporates a pair of between-mattress legs that are foldable against a generally rectangular rail frame that incorporates a flexible fabric barrier. Joints in the middle of the rectangular frame allow for the frame itself to be folded in half after collapsing the rail against the support legs.

U.S. Pat. No. 5,519,905, issued to Bernstein et al. entitled Bed Side Rails. This patent describes a rigid rail system intended to partially cover the side of a child's bed. Between-mattress legs are hingedly attached to the side rail in a manner that permits the complete lowering of the side rail from an upright position to a lowered and flat against the bed position when the rail is not in use. The rail itself comprises a rigid structure that is generally not collapsible or variable in length or height.

U.S. Pat. No. 5,577,277, issued to Sundberg et al. entitled Collapsible Bed Side Rail. This patent describes a generally rigid set of components intended to be attached together (as opposed to being hingedly folded) to form a side rail with between-mattress support legs. The rail barrier itself divides into two sections which compactly integrate the leg and support systems into a single compact storage unit.

U.S. Pat. No. 6,134,731, issued to Thom et al. entitled Adjustable Support Apparatus. This patent describes a partial wall rail barrier for a bed. The rail is intended primarily for older individuals, and provides a handle structure to be grasped by the person in bed in order to assist with lifting themselves to an upright position.

U.S. Pat. No. 6,453,490, issued to Cardinale entitled Bed Safety Guard. This patent is directed primarily to the between-mattress support structures and describes a system whereby the between-mattress legs extend entirely across the mattress to an attachment point on the opposite side of the bed. This arrangement is intended to provide improved support that prevents the rail from being dislodged or pushed away from the bed by the occupant.

U.S. Pat. No. 5,640,726 issued to Fichner-Rathus entitled Safety Rail for Sleeping Beds. This patent likewise describes a side rail system with between-mattress legs that extend completely across the mattress to an opposite side of the bed. Adjustments to both the cross mattress components and the side bed components allow for a tight fit on a variety of mattress structures. The rail itself is described as a rectangular frame with a mesh or fabric barrier.

While many attempts have been made in the past to provide removable rail systems, some of which are foldable into a lowered position, few if any of the devices provide for the needs of the intermediate aged child that is still young enough to utilize a crib as a sleeping environment, and yet active and mobile enough to be able to enter and exit the crib on their own. Rails currently available for retail purchase are typically either too short or too long to completely enclose a crib mattress. Those that are too short are intended to allow the child access to and from the crib when awake, but then leave the opening for the child to fall from while sleeping. Those that are too long cannot be safely used with cribs because the under-mattress support legs do not appropriately engage the mattress and are therefore not stable. In general, these rails do not permit the child to safely enter or exit the crib. The two goals of (1) providing a safe sleeping environment and (2) providing an accessible sleeping environment for the young, but active child, are simply not met by any system described in the prior art. It would be desirable therefore to have a removable rail system that positions a rail of adequate height on the side of a mattress so as to prevent a child from rolling from the crib during sleep, while at the same time providing a mechanism or component that allows the child to "scale" the rail from the outside of the crib so as to enter the crib to sleep. It would further be desirable for such a system to be safely attachable to or removable from the crib frame, and yet rigid enough upon attachment to be climbed upon by the child.

SUMMARY OF THE INVENTION

It is therefore an object of the present invention to provide a system that combines a side rail and a ramp structure that are attachable in combination to a crib or a bed in a manner that prevents the child in the crib or bed from rolling out during sleep, and at the same time provides a means for the child to climb or crawl from outside the crib, up to the railing, and over the railing so as to access the mattress of the crib or bed to go to sleep. The various preferred embodiments of the present invention each include a side rail component that is fixed to the crib or bed at each end by removable attachment straps or the like, and is rigidly connected to a pair of leg extensions that slide between the mattress and box spring of the crib or bed. A generally larger ramp component extends pivotally outward and downward from the side rail component to a point in contact with the floor on which the crib or bed is positioned. The angle and dimensions of the ramp are such as to permit an active child to crawl up the ramp to a point to where it becomes easy to climb over the rail on the side of the crib or bed. Various preferred embodiments of the present invention incorporate multiple hinged components within the ramp system so as to allow the alternate positioning of the ramp (in whole or in parts) in an extended configuration or a collapsed configuration against the crib or bed.

DETAILED DESCRIPTION OF THE PREFERRED EMBODIMENTS

Figure 1:
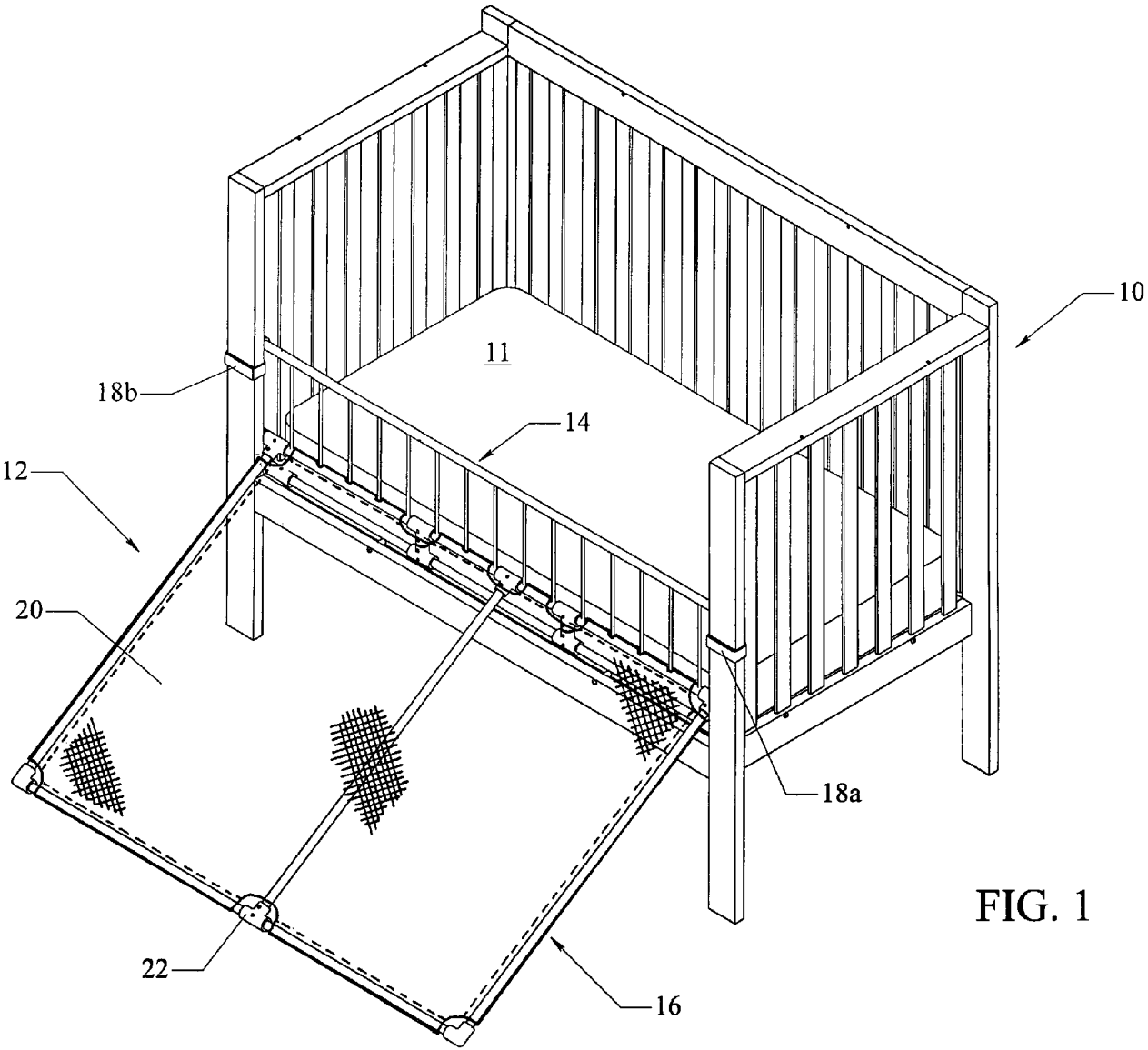
FIG. 1 is a perspective view of a first embodiment of the present invention shown attached to a crib of standard configuration.

Reference is made first to FIG. 1 for a brief description of the implementation of a first embodiment of the present invention on a standard crib enclosure. FIG. 1 shows crib 10 as a typical crib enclosure with one removable side, leaving a mattress 11 surrounded on three sides by the crib end panels and side railing and open on a fourth side for placement of the present invention. Ramp/rail assembly 12 is positioned and attached to crib 10 as shown in FIG. 1. Ramp/rail assembly 12 includes rail sub-assembly 14 which is positioned directly onto crib 10 through the use of attachment bands 18*a* and 18*b*. The mechanism for attachment in this manner is described in more detail below with reference to FIGS. 3 and 3A.

Ramp/rail assembly 12 also comprises ramp sub-assembly 16 which extends downward and away from rail sub-assembly 14 positioned on crib 10. Ramp sub- assembly 16 is comprised of ramp frame sub-assembly 22 and ramp surface 20.

In the preferred embodiment shown in FIG. 1, ramp frame sub-assembly 22 is made up of semi-rigid tubular components joined together to form a generally rectangular frame as indicated in the drawing. Ramp surface 20 is positioned over and around ramp frame sub-assembly 22 so as to provide a light-weight, flexible surface to the rectangular plane defined by ramp frame sub-assembly 22. As indicated in FIG. 1, ramp surface 20 may be a fabric material, most preferably an open mesh fabric constructed of soft polyester fibers, that is stretched across ramp frame sub-assembly 22, around the individual edge components of ramp frame sub-assembly 22, and sewn (or snapped, zipped, etc.) back onto itself or the ramp frame sub-assembly to form a secure platform made of fabric.

As shown in FIG. 1, ramp sub-assembly 16 is pivotally connected to rail sub-assembly 14 in a manner described in more detail below. In this configuration, the two primary components of ramp/rail assembly 12 define a first vertical plane comprising rail sub-assembly 14 and a second horizontally-angled plane defined by ramp sub-assembly 16. The child may utilize the ramp/rail assembly 12 of the present invention by crawling up or down the ramp sub-assembly 16 of the device. The height of rail sub-assembly 14 is sufficiently low such that the child may readily enter the crib enclosure or exit the crib enclosure if such is the intent. Rail sub-assembly 14 is, however, sufficiently high as to prevent the child, when asleep or partially asleep, from unintentionally falling out of crib 10. In this manner, the ramp/rail assembly 12 of the present invention provides an easy and safe means for a child to enter or exit crib 10, when such is the child's intent.

Figure 2:
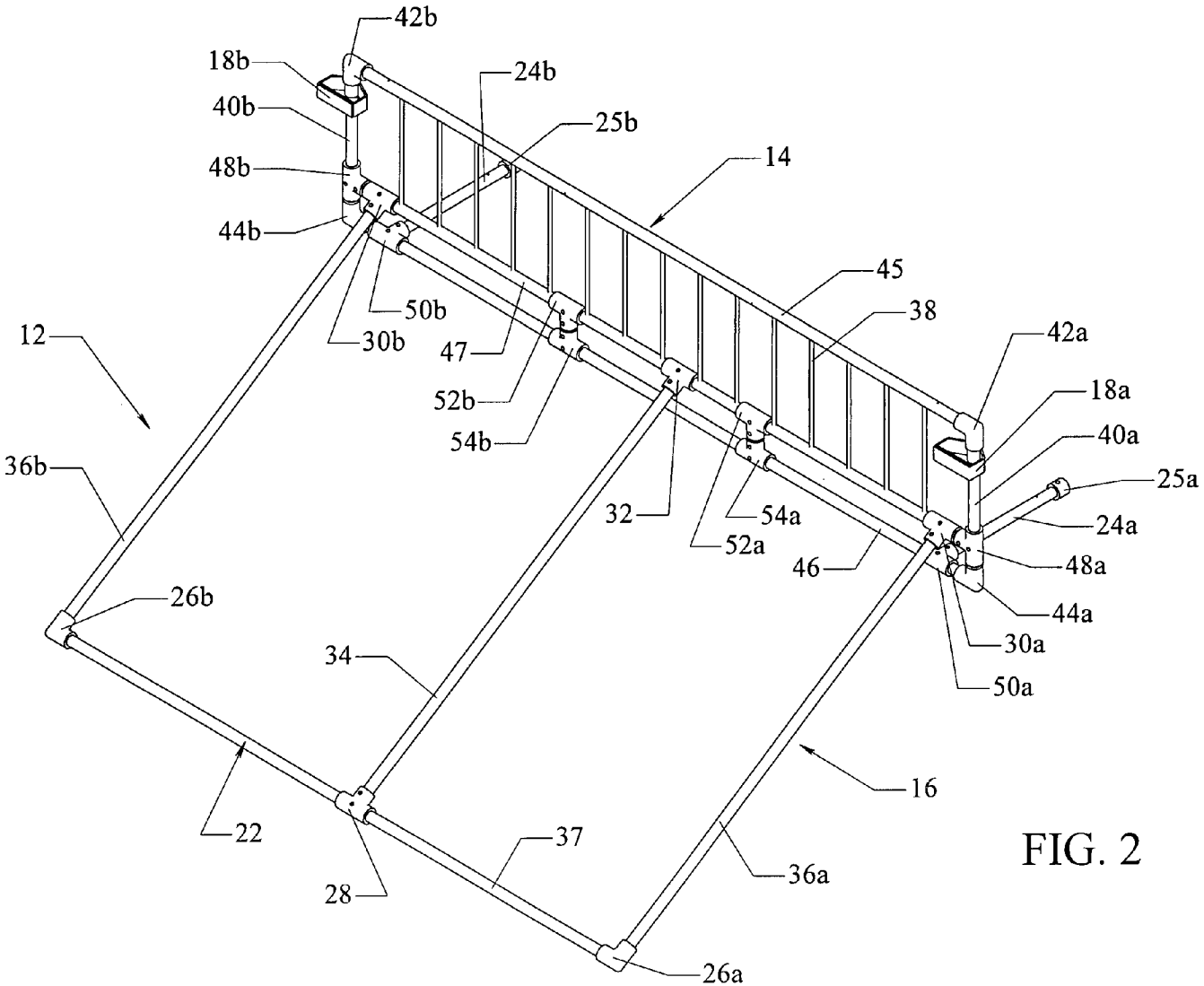
FIG. 2 is a detailed perspective view of the structure of the first preferred embodiment of the present invention shown in FIG. 1.

Reference is now made to FIG. 2 for a more detailed description of the structure of ramp/rail assembly 12 of the present invention as shown in FIG. 1. Once again ramp/rail assembly 12 is comprised of rail sub-assembly 14 and ramp sub-assembly 16. The additional components not shown in FIG. 1, but which make up part of ramp/rail assembly 12, include mattress legs 24*a* and 24*b*. These mattress legs 24*a* and 24*b* are capped respectively with leg caps 25*a* and 25*b*. Mattress legs 24*a* and 24*b* are attached to rail sub-assembly 14 in a manner described in more detail below and are utilized for the purpose of helping to stabilize rail sub-assembly 14 in its attachment to crib 10. Mattress legs 24*a* and 24*b* are inserted and positioned below mattress 11 (shown in FIG. 1) and in conjunction with attachment bands 18*a* and 18*b* serve to stabilize and position rail sub-assembly 14 on crib 10, closely adjacent to mattress 11.

As indicated above, ramp sub-assembly 16 is made up of ramp frame sub-assembly 22 and ramp surface 20 (not shown in FIG. 2 for clarity). Ramp frame sub-assembly 22 is made up of a generally rectangular set of tubular components and joint connectors as shown. These components include ramp side braces 36*a* and 36*b*, ramp base brace 37, and ramp center brace 34. Ramp base corner joints 26*a* and 26*b* serve to connect ramp side braces 36*a* and 36*b* to ramp base brace 37. Ramp base center joint 28 serves to connect ramp center brace 34 to ramp base brace 37.

Ramp frame sub-assembly 22, and therefore ramp sub-assembly 16, is connected to rail sub-assembly 14 by way of ramp top corner pivot joints 30*a* and 30*b* and ramp top center pivot joint 32. Ramp top corner pivot joints 30*a* and 30*b*, as well as ramp top center pivot joint 32, are designed to position and fix ramp sub-assembly 16 side-to-side on rail sub-assembly 14, but to permit the angular rotation of ramp sub-assembly 16 up and down in pivoting relationship to the plane of rail sub-assembly 14. In other words, the corner and center pivot joints allow the user to lift ramp sub-assembly 16 and additionally allow variability in the height of the crib to which the present invention is mounted.

Rail sub-assembly 14 is comprised of rail top brace 45, rail center brace 47, and rail base brace 46, all of which are in generally parallel, coplanar relationship to one another. Extending between rail top brace 45 and rail center brace 47 are a plurality of rail bars 38. The base of rail sub-assembly 14 is made up of rail side braces 40*a* and 40*b* which are connected to rail top brace 45 by way of rail top joints 42*a* and 42*b*, and are connected to rail base brace 46 by way of rail base joints 44*a* and 44*b*. Rail side braces 40*a* and 40*b* are connected to rail center brace 47 by way of rail side joints 48*a* and 48*b*.

As identified above, the pair of mattress legs 24*a* and 24*b*, are connected to rail base brace 46 by way of mattress leg joints 50*a* and 50*b*. In the preferred embodiment, these mattress leg joints 50*a* and 50*b* are fixed both laterally on rail base brace 46 and pivotally fixed (non-rotational) so as to facilitate the rigid placement of rail sub-assembly 14 adjacent the mattress of the crib.

Finally, additional support within rail sub-assembly 14 is provided by rail center brace support joints 52*a*, 52*b*, 54*a*, and 54*b*, which extend between and fix in parallel relationship, rail center brace 47 and rail base brace 46.

Figure 3A:
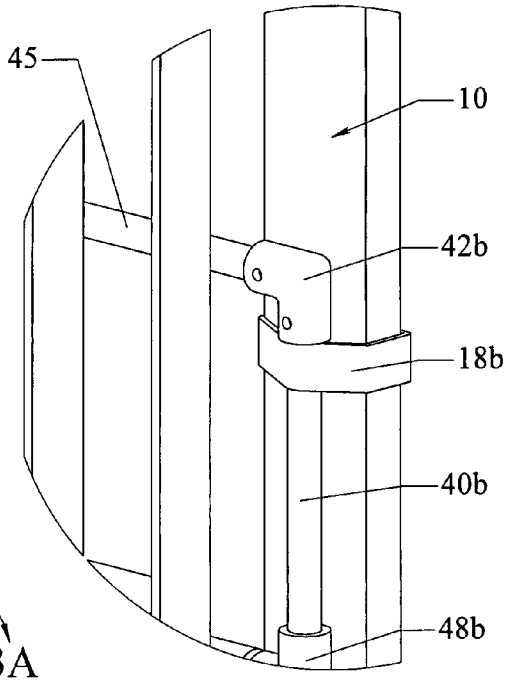
FIG. 3A is a detailed view of the attachment means shown generally in FIG. 3.
Figure 3:
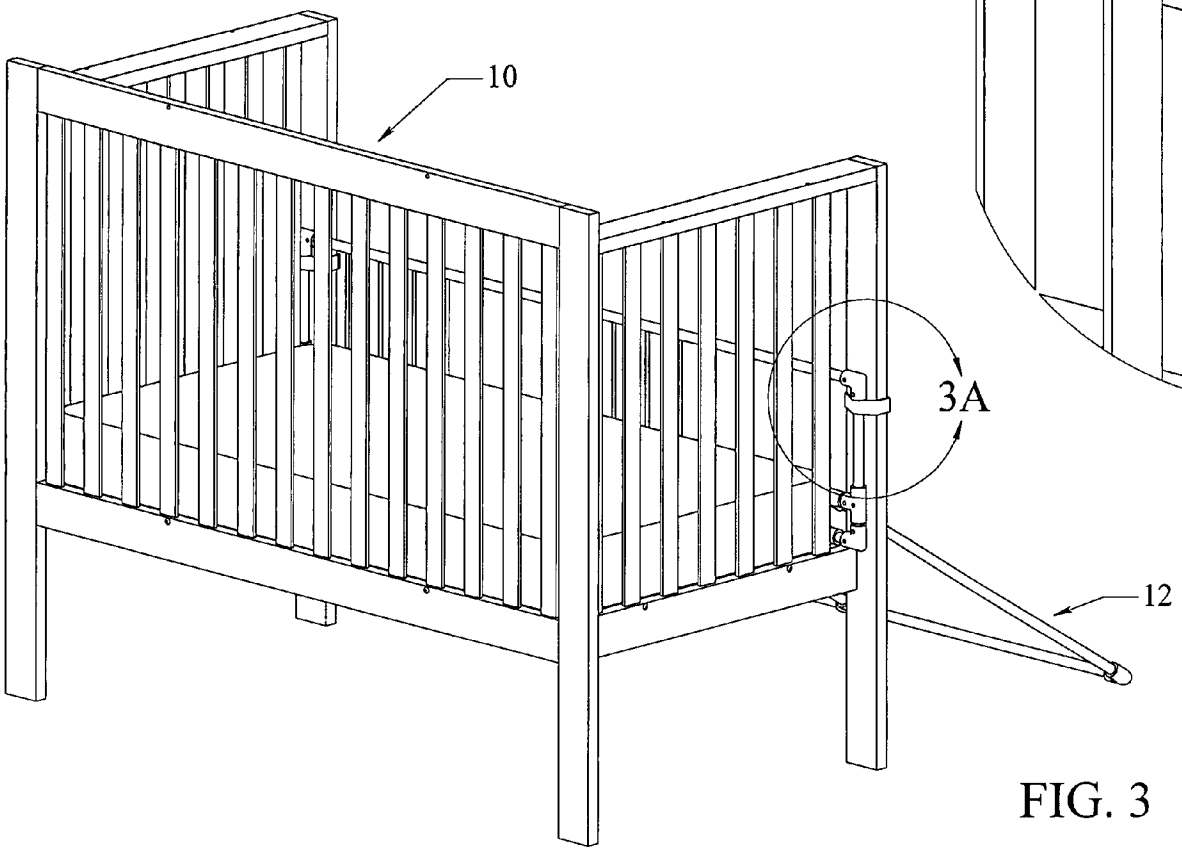
FIG. 3 is a reverse perspective view showing means for attaching the present invention to a crib of standard configuration.

Reference is now made to FIG. 3 for a brief description of the use of attachment bands 18*a* and 18*b* in facilitating the fixed positioning of ramp/rail assembly 12 of the present invention on crib 10. In this reverse view, and in the detailed view shown in FIG. 3A, rail sub-assembly 14 of ramp/rail assembly 12 is positioned adjacent the mattress within crib 10, but inside the posts or legs of crib 10 as shown. In this manner some rigidity is immediately obtained by the pressure of being positioned between the edge of the mattress, and the inside faces of the legs or posts of the crib. It is clear from FIG. 3 that the dimensions of rail sub-assembly 14 of the present invention are dependent upon the dimensions of crib 10, and derive from the distance between the center points of the interior faces of the legs or posts of the crib. In this manner, safe and secure placement and positioning of rail sub-assembly 14 is possible.

As shown in FIG. 3A, rail side brace 40*b* and rail sub-assembly 14 are positioned against the interior face of the crib leg or post as shown. Attachment band 18*b* is wrapped around both rail side brace 40*b* and the leg or post of crib 10 as indicated. This attachment, in combination with the use of mattress legs 24*a* and 24*b* described above, provides a sufficiently rigid means for positioning the present invention on the crib. Attachment band 18*b* is, in the preferred embodiment, a "hook and loop" material type strap that may be wrapped back on itself to provide a secure but removable attachment point. Alternate methods for fixing rail sub-assembly 14 to the leg or post components of crib 10 are anticipated based upon the example of the attachment strap 18*b* shown. It is understood that the detail shown in FIG. 3A is repeated on the opposite end of crib 10 in a mirrored fashion.

Figure 4A:
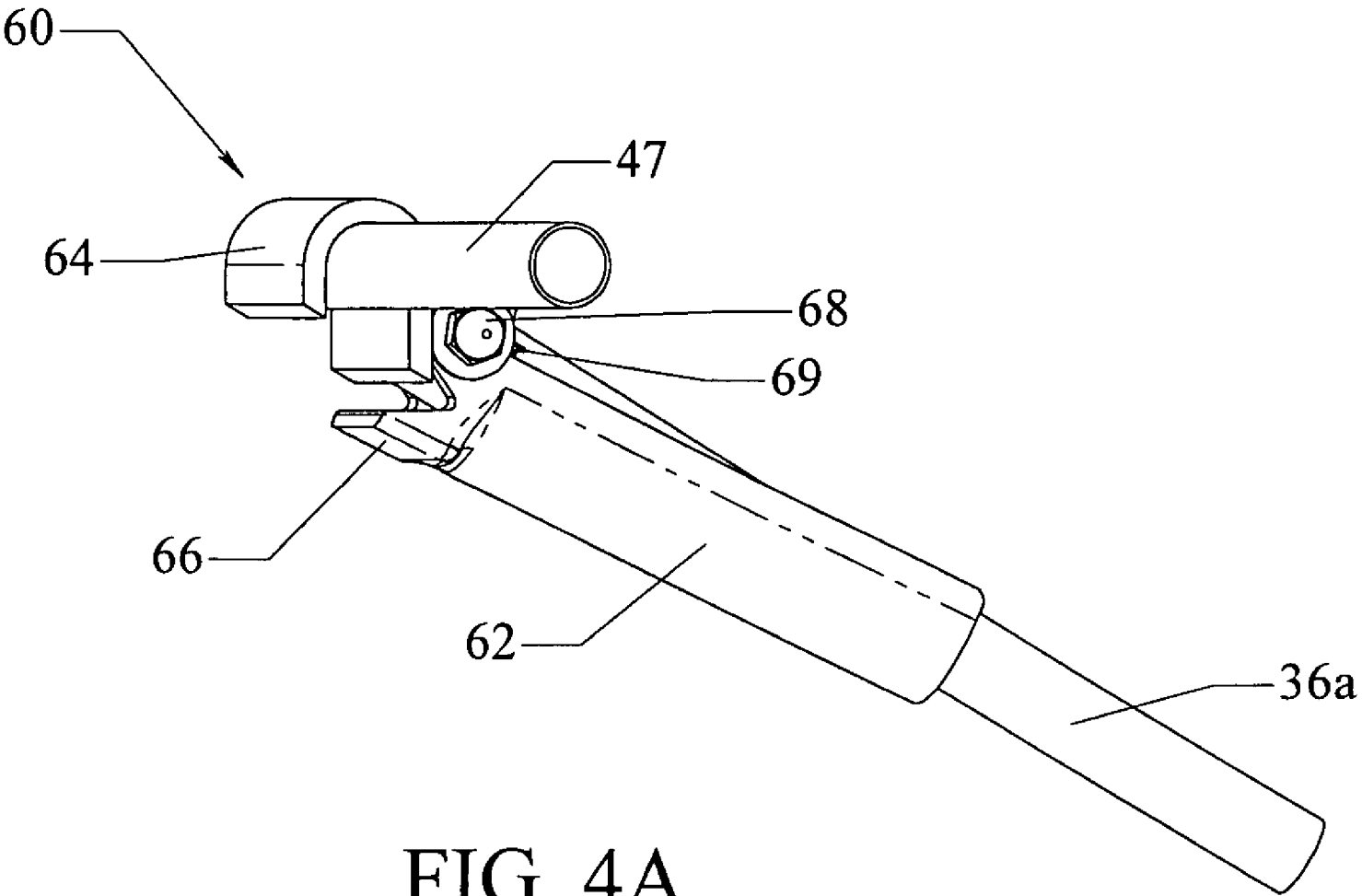
FIG. 4A is a detailed view of an alternate attachment joint for connecting the ramp component of the present invention to the rail component.
Figure 4B:
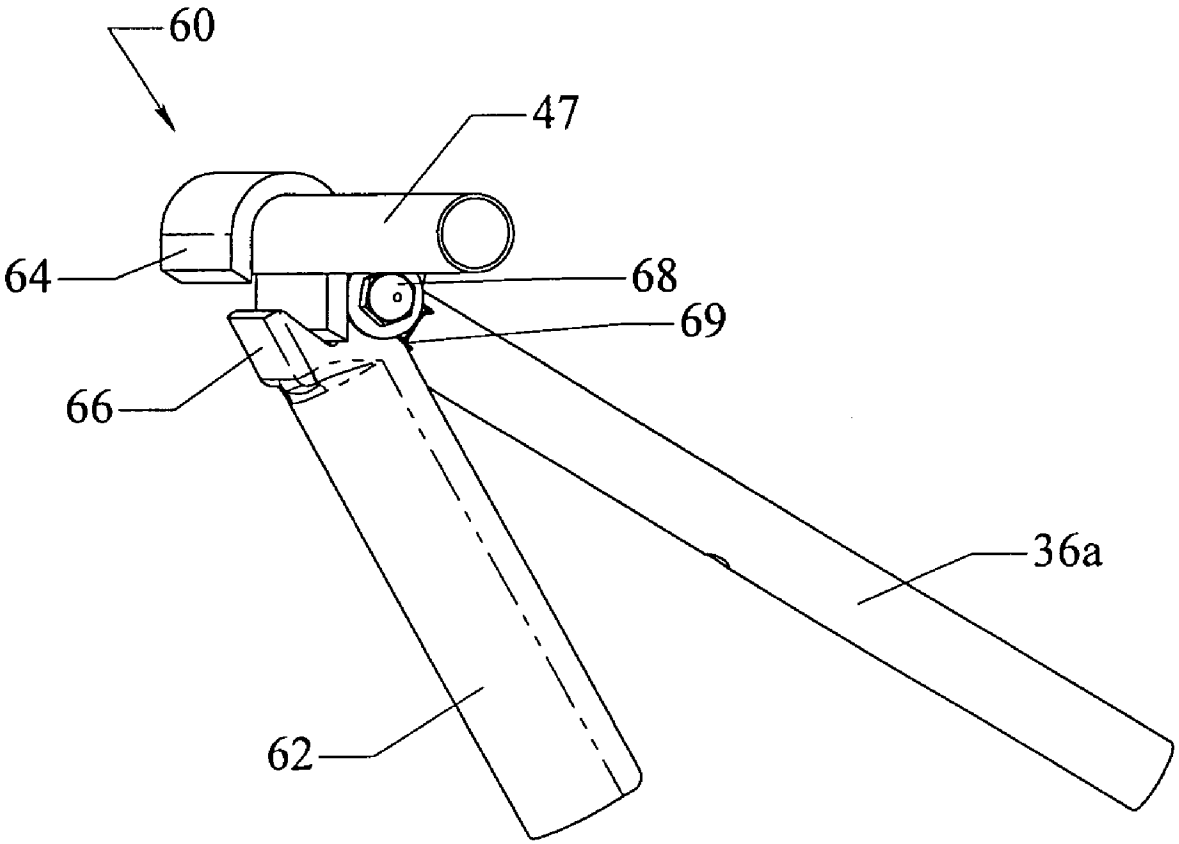
FIG. 4B is a second detailed view of the alternate removable connection joint shown in FIG. 4A.

Reference is now made to FIGS. 4A and 4B for a detailed description of one method for removably attaching ramp sub-assembly 16 of the present invention to rail sub-assembly 14. FIGS. 4A and 4B show an alternate attachment joint that would replace ramp top corner pivot joints 30*a* and 30*b*, all as shown in FIG. 2. Ramp top center joint 32 would likewise be modified into a partially open hook configuration, similar to the attachment joint structure shown in FIGS. 4A and 4B but without the closure mechanism. Under some circumstances it may be desirable to allow the user to completely remove ramp sub-assembly 16 from rail sub-assembly 14 for a variety of reasons, including more direct access to the side of the crib. The pivot joint structures shown in FIGS. 4A and 4B are designed to permit this separation of the components of the present invention. In FIG. 4A, releasable top pivot joint 60 is shown comprised of release handle 62, joint yoke 64, and joint jaw 66. Release handle 62 and joint jaw 66 are pivotally connected to joint yoke 64 by means of joint pivot bolt 68. Release handle spring 69 is positioned in association with this pivot joint. Releasable top pivot joint 60 is positioned on ramp side brace 36*a* (in this example) and serves to replace ramp top corner pivot joint 30*a*, shown in FIG. 2. In this manner, ramp side brace 36*a* is releasably attachable to rail center brace 47 of rail sub-assembly 14. Rail center brace 47 is received into joint yoke 64 and maintained there, initially, by the downward weight of ramp sub-assembly 16. Movement of release handle 62, and therefore joint jaw 66, closes joint jaw 66 around rail center brace 47 to adequately secure the pivoting joint. FIG. 4B shows in greater detail the manner in which the release of release handle 62 closes joint jaw 66 around rail center brace 47 so as to hold rail center brace 47 captive within joint yoke 64.

The above described first preferred embodiment of the present invention is designed to used by a child that is capable of climbing or crawling up the ramp component to the rail component and thereafter climbing over the rail component into the crib to sleep on the mattress. When the child wakes from sleep and wishes to exit the crib, the present invention provides such an exit. The child, when awake and alert, is capable of climbing over the rail component to land on the ramp component. The ramp component is sized and angled so that the child crawling or "falling" from over the rail component would be stopped in his or her vertical descent by the ramp platform material and would be slow to slide down the ramp because of the friction the surface provides. In this manner the child may exit to the floor from the otherwise too high crib mattress surface without the assistance of an adult. The ramp may be left permanently positioned on the side of the crib for this purpose or may be removed as needed if it is configured with the releasable connector joints described in FIGS. 4A and 4B.

Figure 5:
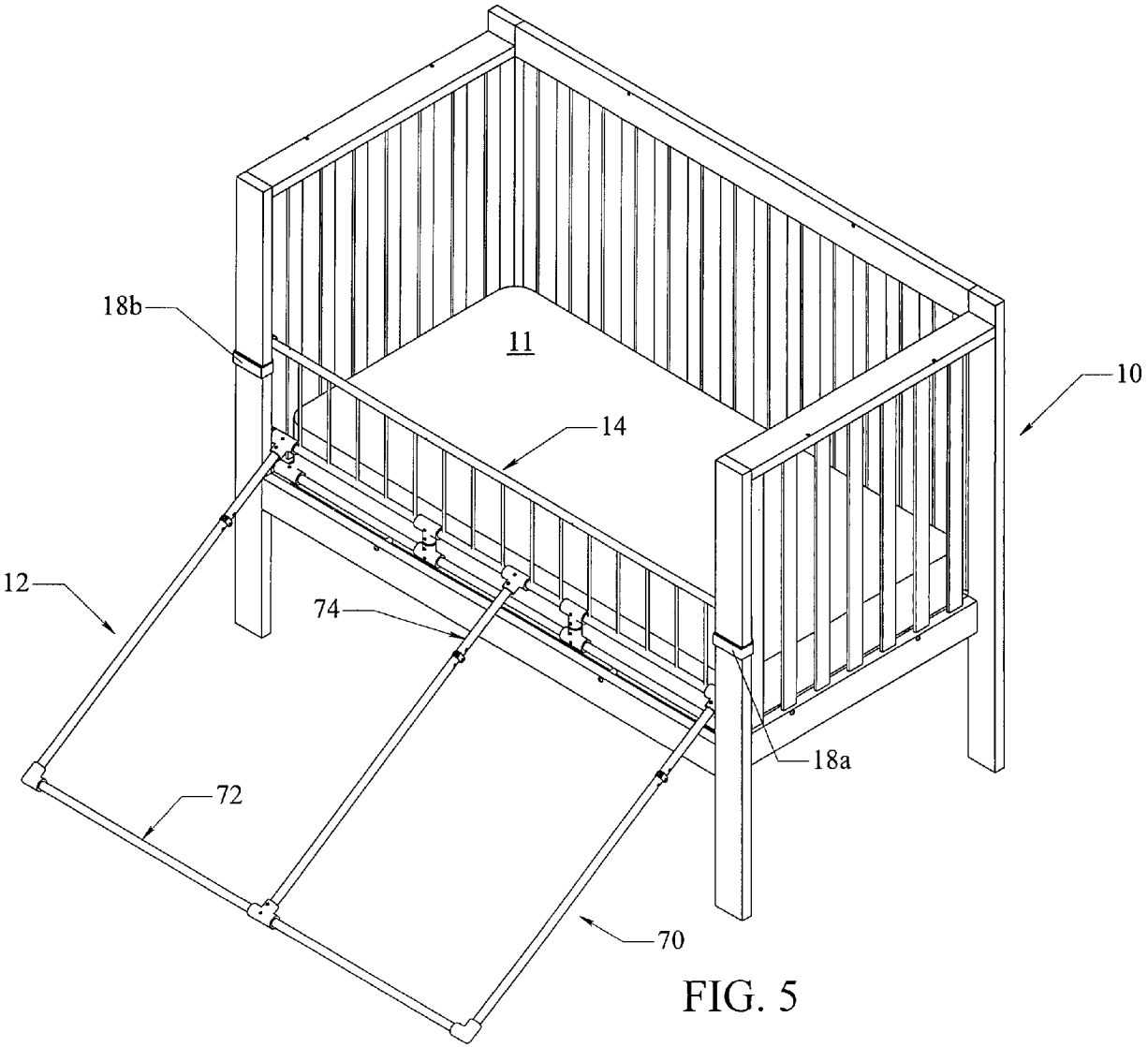
FIG. 5 is a perspective view of a second preferred embodiment of the present invention shown attached to a crib of standard configuration, the ramp component of the invention having a hinged feature.
Figure 6:
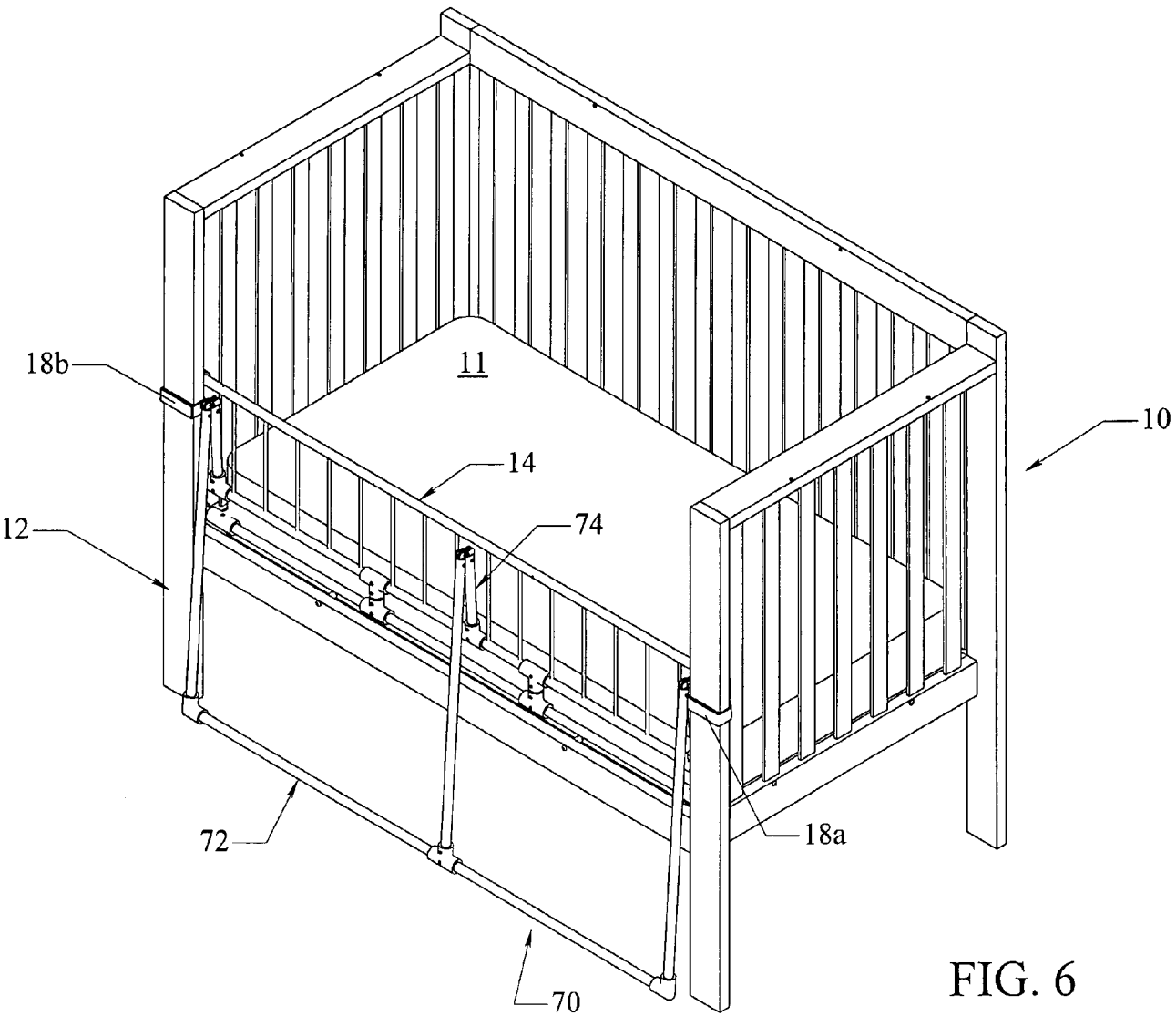
FIG. 6 is a perspective view of the second preferred embodiment shown in FIG. 5, here in a folded configuration.
Figure 7:
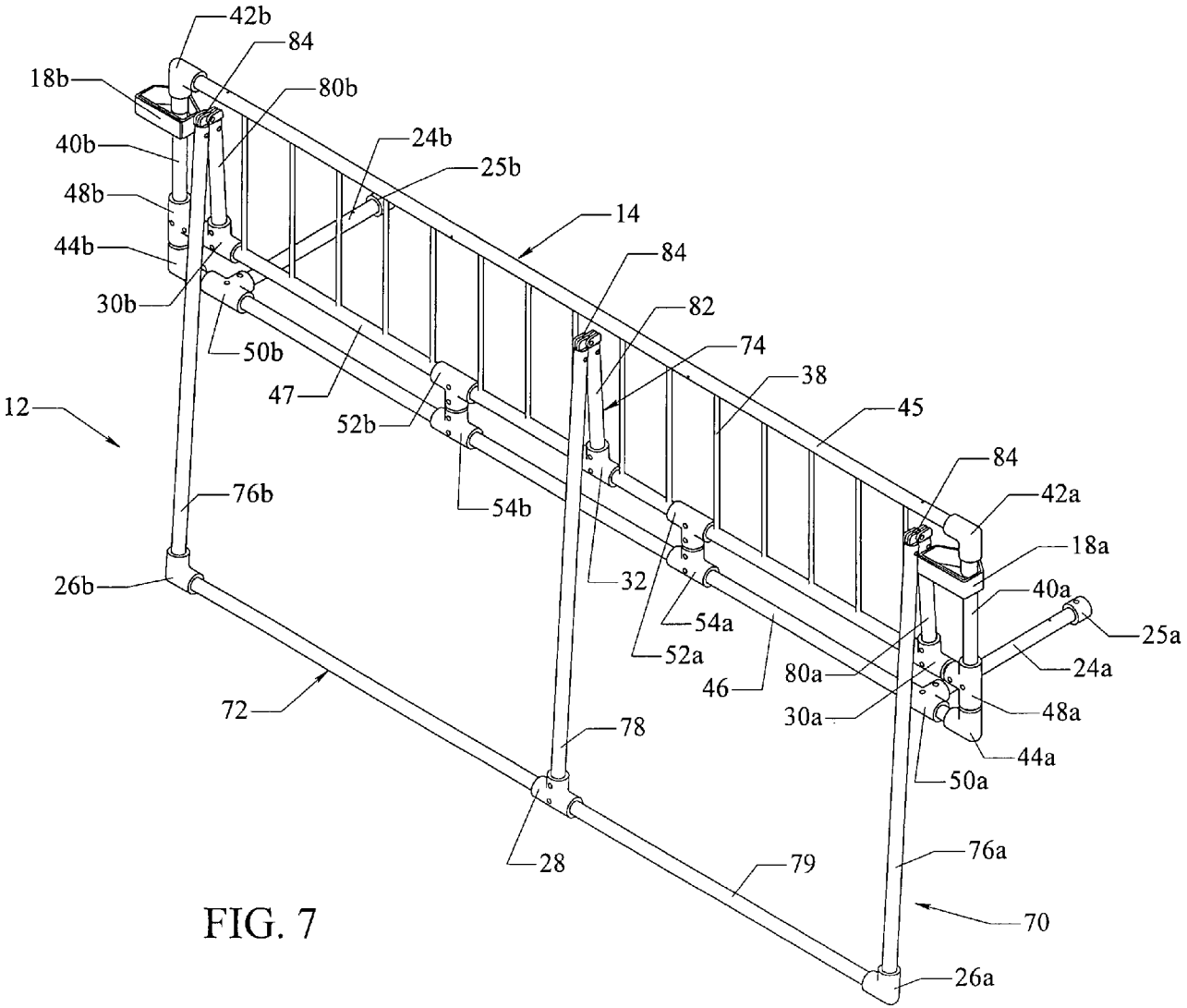
FIG. 7 is a detailed perspective view of the structure of the second preferred embodiment shown in FIG. 5.

Reference is now made to FIGS. 5–7 for a detailed description of a second preferred embodiment of the present invention. Ramp/rail assembly 12 shown in FIG. 5 is designed to have a folding function that permits the user to move ramp sub-assembly 16 into a planar position adjacent the side of crib 10, so as to allow the user more direct access to the crib. The folded configuration of this embodiment is shown in FIG. 6. FIG. 5 discloses the extended configuration of the embodiment, wherein ramp/rail assembly 12 is made up of folding ramp sub-assembly 70, which itself is comprised of folding ramp lower frame sub-assembly 72, and folding ramp upper frame sub-assembly 74. Joints that are described in more detail below connect folding ramp lower frame sub-assembly 72 to folding ramp upper frame sub-assembly 74 and permit the folding or bending of folding ramp sub-assembly 70 in a manner that allows it to be flatly positioned against the side of crib 10 as shown in FIG. 6.

Reference is now made to FIG. 7 for a detailed description of the specific components that make up the second preferred embodiment shown in FIG. 5 and FIG. 6. It should be noted that rail sub-assembly 14 in this embodiment remains structured exactly the same as rail sub-assembly 14 in the initial preferred embodiment mentioned above. Folding ramp sub-assembly 70 once again is comprised of folding ramp lower frame sub-assembly 72 and folding ramp upper frame sub-assembly 74. Folding ramp lower frame sub-assembly 72, itself is comprised of ramp lower side braces 76*a* and 76*b*, as well as ramp lower center brace 78. Ramp lower base brace 79 is essentially identical to ramp base brace 37 shown in the first embodiment described above. Folding ramp upper frame sub-assembly 74 is comprised of ramp upper side braces 80*a* and 80*b*, as well as ramp upper center brace 82. Ramp upper side braces 80*a* and 80*b* are respectively connected to ramp lower side braces 76*a* and 76*b* by means of ramp brace hinges 84. Ramp upper center brace 82 is likewise connected to ramp lower center brace 78 by means of a ramp brace hinge 84. Ramp brace hinges 84 are constructed so as to fold in the direction indicated in the drawings, such that folding ramp upper frame sub-assembly 74 may be rotated upward, thereby drawing in folding ramp lower frame sub-assembly 72 into the coplanar position described above. The hinges 84, however, are structured so as to alternately (and normally) bring the ramp lower side braces 76*a* and 76*b* into alignment with ramp upper side braces 80*a* and 80*b* (likewise with center braces 82 and 78) and to remain rigid in that position preventing the further bending or collapsing of the frame downward. Such hinges structured to stop once the alignment described above has occurred, are well known in the art.

The above described second preferred embodiment of the present invention finds practicality where the parent or caregiver finds it necessary to frequently access the side of the crib to attend to the child. In so far as the ramp, in its lowered position, would likely serve as a barrier to close access, the second embodiment provides a folding ramp that almost entirely eliminates the "protrusion" that the extended ramp would provide on the side of the crib. The hinge structure, and its location on the ramp frame, is such that the ramp may be folded upward with the appropriate force being exerted inward on the lower edge of the ramp towards the crib. In this manner, the adult or care giver may generally fold the ramp by pushing against the lower edge of the ramp with their foot. Extending the ramp again can be accomplished by drawing the lower edge of the ramp out again from the crib and allowing gravity to pull the ramp sections once again into an inclined plane configuration. Hinges of the type that bend in only one direction (and provide stiff resistance to bending in the opposite direction) are well known in the art.

Figure 8:
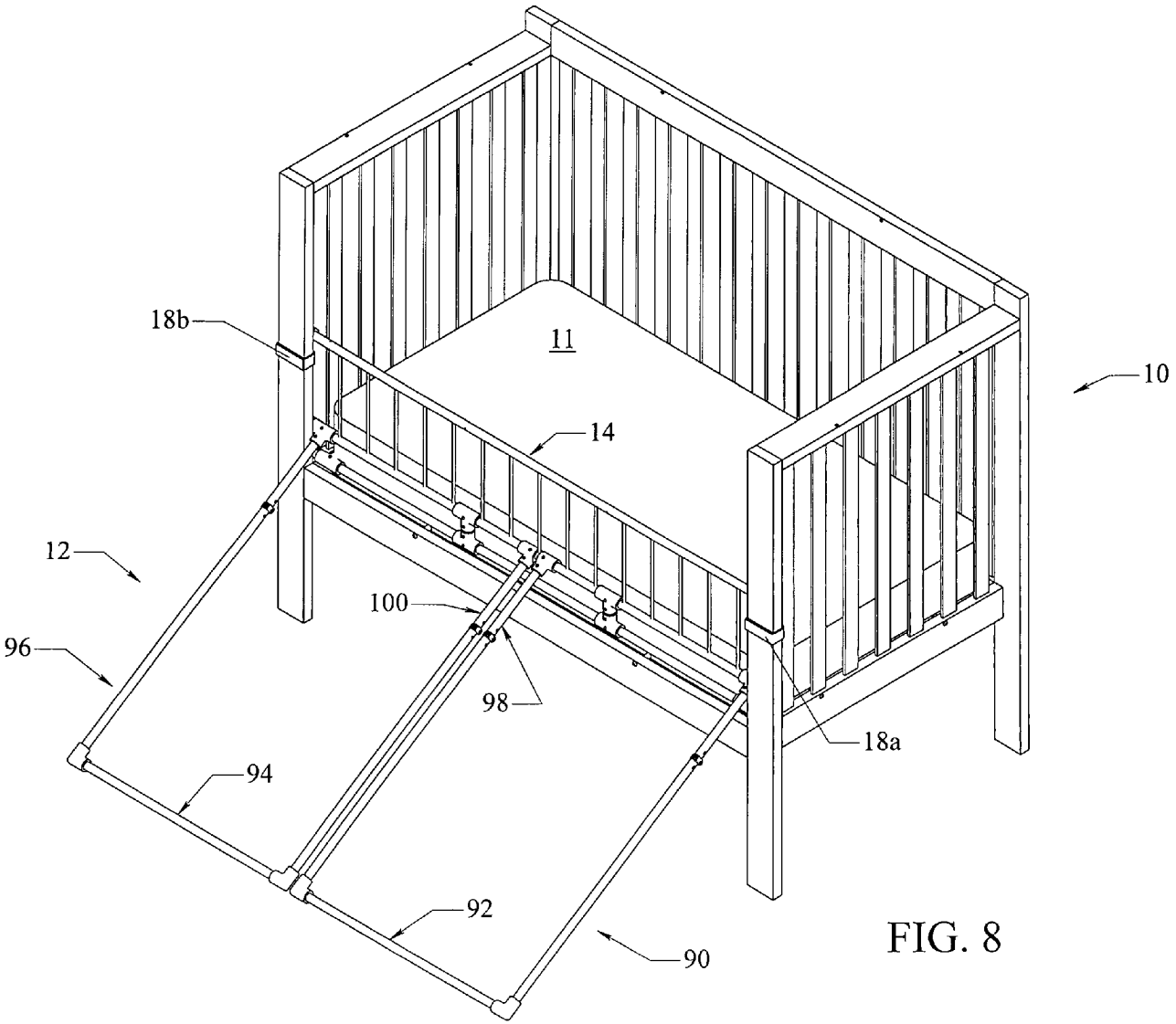
FIG. 8 is a perspective view of a third preferred embodiment of the present invention shown attached to a crib of standard configuration, the ramp component having multiple ramp sections.
Figure 9A:
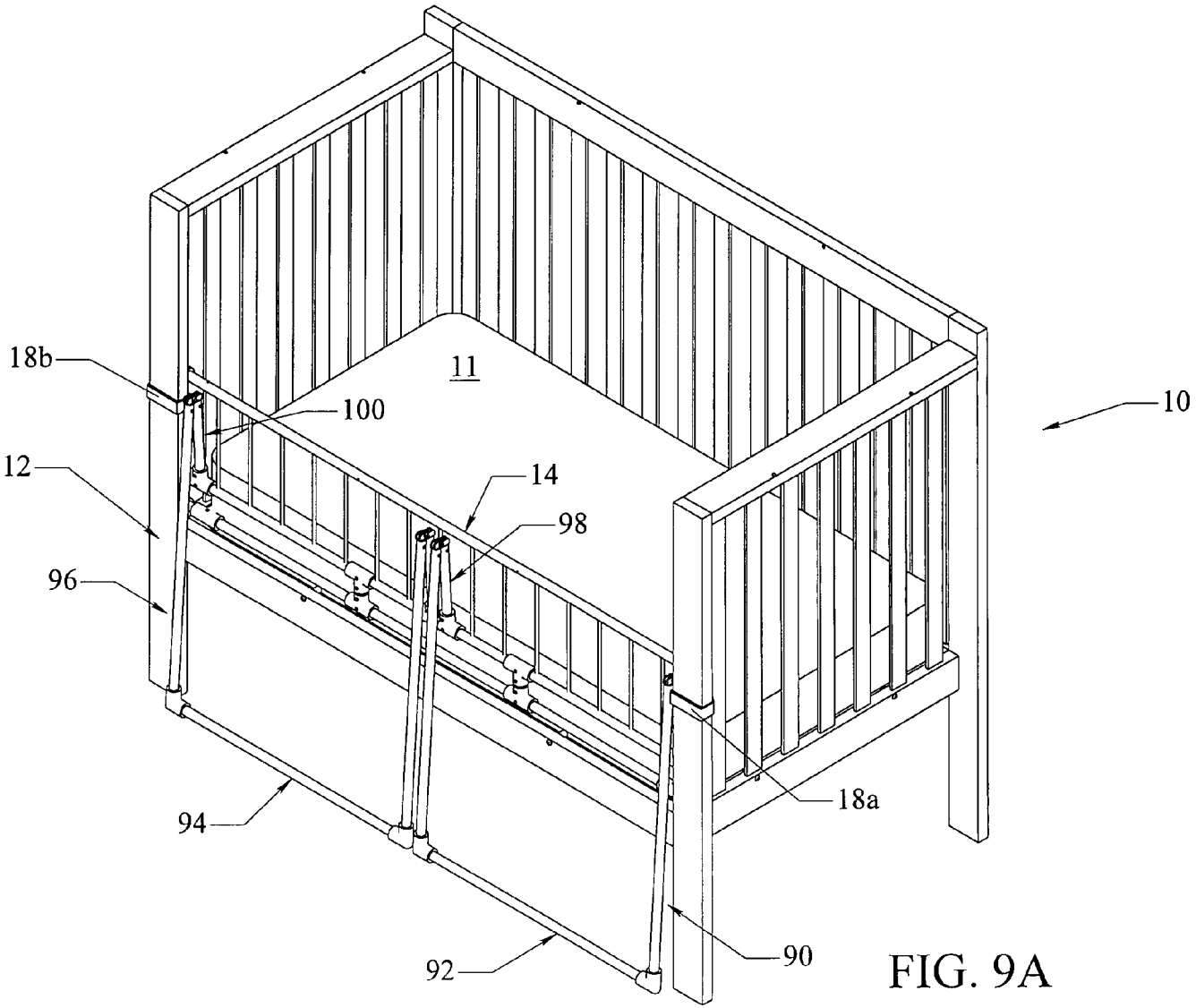
FIG. 9A is a perspective view of the third preferred embodiment shown in FIG. 8, here in a folded configuration.
Figure 9B:
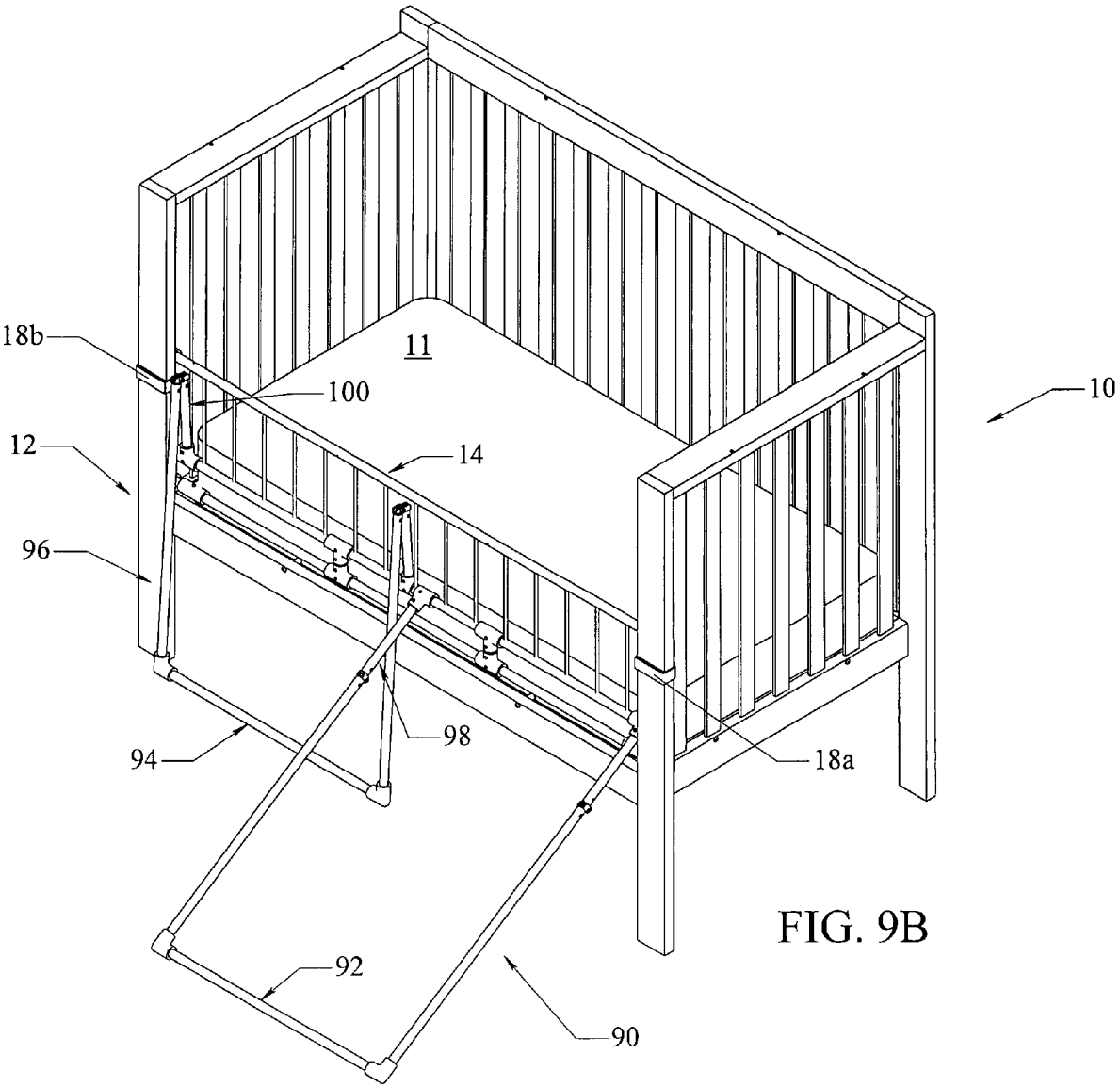
FIG. 9B is a perspective view of the third preferred embodiment shown in FIG. 8, here in a partially folded configuration.
Figure 9C:
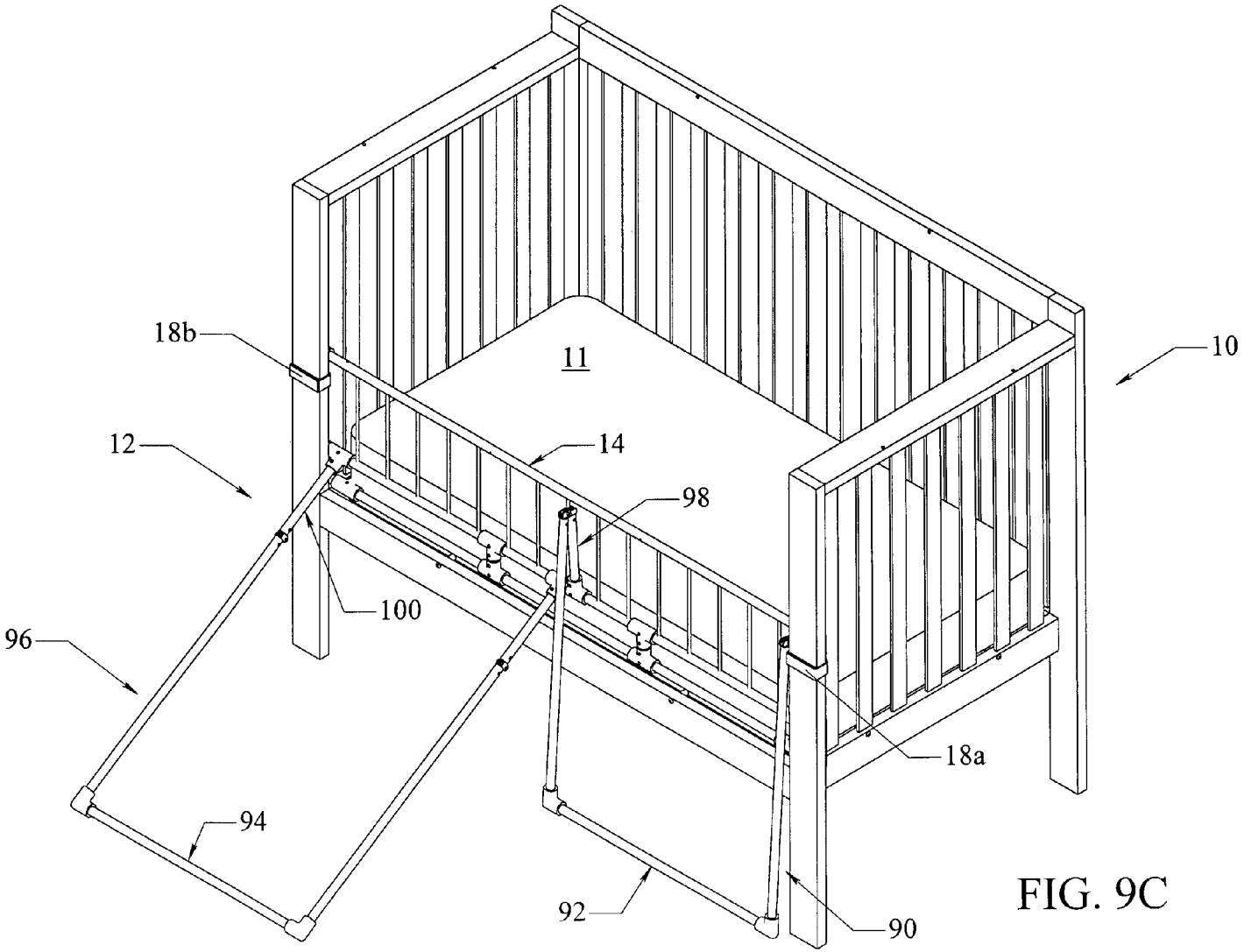
FIG. 9C is a perspective view of the third preferred embodiment shown in FIG. 8, here in an alternate partially folded configuration.

Reference is now made to FIGS. 8, 9A, 9B, 9C and 10 for a detailed description of a third alternative preferred embodiment of the present invention. In FIG. 8, ramp/rail assembly 12 is seen once again to be comprised of rail sub-assembly 14, but instead of a single ramp sub-assembly attached to rail sub-assembly 14, a dual folding ramp structure is disclosed. This dual folding ramp system is comprised of dual-folding ramp right sub-assembly 90, and dual-folding ramp left sub-assembly 96. Dual-folding ramp right sub-assembly 90 is comprised of dual-folding ramp right lower frame sub-assembly 92, and dual-folding ramp right upper frame sub-assembly 98. Likewise, dual-folding ramp left sub-assembly 96 is comprised of dual-folding ramp left lower frame sub-assembly 94, and dual-folding ramp left upper frame sub-assembly 100. The manner in which the assemblies of the dual-folding ramp structure fold with respect to one another is identical to that described above in the second preferred embodiment utilizing hinges 84. In this case, however, two separate folding ramps are positioned so as to permit the user to either fold both ramps at the same time, or a single ramp at a time. These various folding configurations are shown in FIGS. 9A, 9B, and 9C. FIG. 9A shows the dual folding ramp system wherein both dual-folding ramp right sub-assembly 90 and dual-folding ramp left sub-assembly 96 are each folded into coplanar relationship with rail sub-assembly 14, close to the side of crib 10. FIG. 9*b* shows dual-folding ramp right sub-assembly 90 extended into its ramp configuration while dual-folding ramp left sub-assembly 96 remains folded against the side of crib 10. In the opposite configuration, FIG. 9*c* discloses dual-folding ramp left sub-assembly 96 extended and dual-folding ramp right sub-assembly 90 folded against the side of crib 10.

Figure 10:
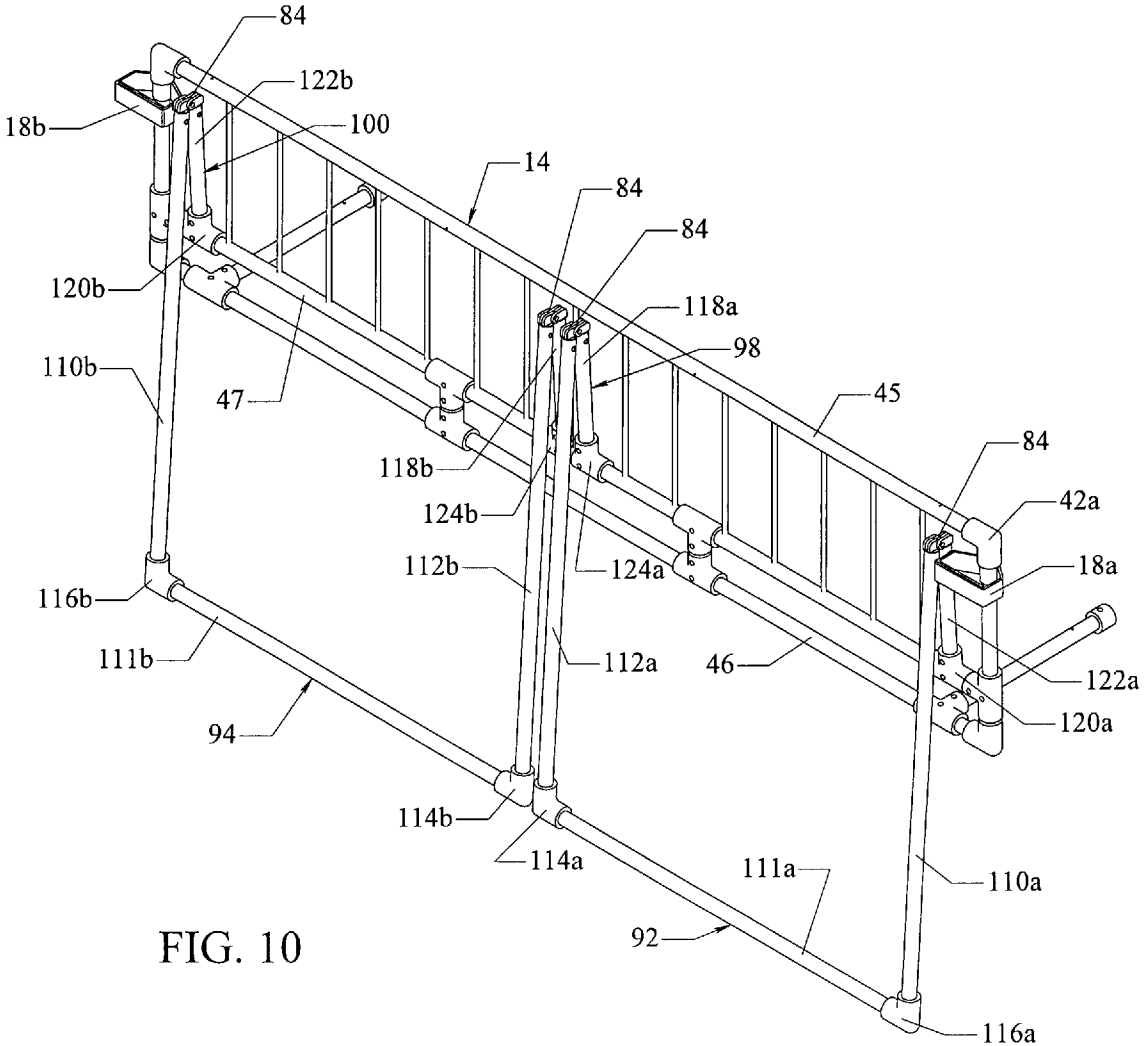
FIG. 10 is a detailed perspective view of the multiple ramp sections embodiment of the present invention shown in FIG. 8.

Reference is finally made to FIG. 10 for a detailed description of the additional components incorporated into the structure associated with the above described dual-folding ramp system. Here again, rail sub-assembly 14 is identical to the rail sub-assembly described above with respect to the first and second preferred embodiments. Dual-folding ramp right lower frame sub-assembly 92 is made up of right ramp lower side brace 110*a*, right ramp lower base brace 111*a*, and right ramp lower center brace 112*a*. Likewise, dual-folding ramp left lower frame sub-assembly 94 is made up of left ramp lower side brace 110*b*, left ramp lower base brace 111*b*, and left ramp lower center brace 112*b*. The joints for connecting the center and side braces described above include right ramp lower center base joint 114*a*, left ramp lower center base joint 114*b*, right ramp lower corner base joint 116*a*, and left ramp lower corner base joint 116*b*.

The dual-folding ramp right upper frame sub-assembly 98 is comprised of right ramp upper center brace 118*a* and right ramp upper side brace 122*a*. The dual-folding ramp left upper frame sub-assembly 100 is comprised of left ramp upper center brace 118*b* and left ramp upper side brace 122*b*. The joints for connecting the center and side braces of dual-folding ramp right upper frame sub-assembly 98 and dual-folding ramp left upper frame sub-assembly 100 include right ramp upper side pivot joint 120*a*, left ramp upper side pivot joint 120*b*, right ramp upper center pivot joint 124*a*, and left ramp upper center pivot joint 124*b*.

The third preferred embodiment described above finds practicality where both use of the ramp and direct access to the side of the crib are desired. Although it is obviously necessary for the railing of the present invention to extend down the entire length of the open side of the crib, it is not typically necessary for the ramp to be this wide. The third embodiment therefore provides for a system that accommodates both the use of the ramp by the child and access to the side of the crib by the adult. The process of folding or extending each ramp section is the same as with the second embodiment described above but may be accomplished with both ramp sections together or each ramp section independently. The division of the ramp may be into two sections (as shown) or may be more under certain circumstances. Likewise the division of the ramp may be into equal sections (as shown) or unequal under certain circumstances. In any event, the third embodiment provides versatility in user configuration of the ramp component of the present invention.

Although the present invention has been described in conjunction with a number of preferred embodiments, those skilled in the art will recognize further alterations of the structures described that still fall within the scope of the invention as defined by the claims that follow. For example, but without limitation, the components of the frame structures of the invention as described are generally shown as round tubular sections. Those skilled in the art will recognize that longitudinal sections of a solid nature and/or of alternate cross-section (such as square) are possible. Likewise, the material from which these frame sections might be constructed could be any of a number of rigid or semi-rigid compositions available for such longitudinal elements. For example, but again without limitation, the tubular sections might be constructed of strong (schedule 40 or greater) PVC pipe sections or may be constructed of metal tubular components. Those skilled in the art will recognize the balance required between rigidity and flexibility in selecting the most appropriate materials. Finally, again without limitation, the construction of the platform that provides the climbing surface in the present invention may be from any of a number of different materials from a coarse mesh to a tightly woven fabric. Comfort and strength will generally govern the choice of material for the platform.

I claim:

1. A system for allowing access to, and egress from, a child's crib by the child using said crib, said crib positioned on a support surface and having an elevated sleeping surface enclosed on three of four sides, said child being too small to easily access the height of said sleeping surface on said crib but agile enough to climb an inclined surface to such a height, the system comprising:

a ramp frame positioned proximate to said crib, said frame defining an inclined plane extending continuously from a location adjacent said elevated sleeping surface of said crib along an unenclosed one of said four sides of said elevated sleeping surface, to a location on said support surface apart from said crib, said ramp frame having a width approximately equal to a width of said unenclosed one of said four sides of said elevated sleeping surface; and a ramp surface positioned on and attached to said ramp frame, said ramp surface further defining said inclined plane and providing the surface to said inclined plane extending continuously from said elevated sleeping surface to said support surface, said ramp surface capable of supporting the weight of said child ascending or descending between said elevated sleeping surface and said support surface.

2. The system of claim 1 wherein said ramp frame is pivotally attached to said crib at at least one point along said width of said unenclosed one of said four sides of said elevated sleeping surface.

3. The system of claim 2 wherein said ramp frame further comprises a plurality of hinge joints, said hinge joints allowing said frame to be folded so as to collapse against the side of said crib in a manner that allows direct access to the side of said crib.

4. The system of claim 3 wherein said ramp frame comprises first and second ramp elements and said ramp surface comprises first and second surface elements, each of said ramp elements defining a divided portion of said inclined plane, each of said ramp elements independently foldable against the side of said crib and independently extendable to said support surface.

5. The system of claim 2 wherein said ramp fame is removably attachable to said crib and further comprises a plurality of pivoting, releasable connectors.

6. The system of claim 5 wherein said plurality of pivoting, releasable connectors each comprise a spring-loaded/closing, hand-operable/opening, engagement hook capable of being hooked onto said crib and holding said ramp frame captive on said crib when released.

7. The system of claim 1 further comprising a railing positioned on and attached to said crib so as to provide low level closure of said unenclosed side of said sleeping surface, said low level closure extending fully across said open side of said sleeping surface and above said sleeping surface but below a level of enclosure on the remaining three sides, said railing comprising and providing a point of attachment between said ramp frame and said crib.

8. The system of claim 7 wherein said ramp frame is pivotally attached to said railing.

9. The system of claim 8, wherein said ramp frame is removably attachable to said railing and further comprises a plurality of pivoting, releasable connectors.

10. The system of claim 9 wherein said plurality of pivoting, releasable connectors each comprise a spring-loaded/closing, hand-operable/opening, engagement hook capable of being hooked onto said railing and holding said railing captive when released.

11. The system of claim 7 wherein said crib comprises corner posts and said system further comprises attachment straps for securing said railing to said crib at least one of said corner posts.

12. The system or claim 7 wherein said railing further comprises at least one under mattress leg, said at least one leg providing a rigid support to help maintain said railing in an upright position adjacent said sleeping surface.

13. The system of claim 7 wherein said railing comprises a horizontal top bar and a horizontal bottom bar and a plurality of vertical rungs extending between said top bar and said bottom bar.

14. The system of claim 13 wherein said horizontal bottom bar comprises upper and lower parallel bottom bar elements, said plurality of vertical rungs extending from said upper bottom bar element and said ramp frame is attached to said upper bottom bar element.

15. The system of claim 7 wherein said ramp frame further comprises a plurality of hinge joints, said hinge joints allowing said frame to be folded so as to collapse against the side of said railing and said crib in a manner that allows direct access to the side of said crib.

16. The system of claim 15 wherein said ramp frame comprises first and second ramp elements and said ramp surface comprises first and second surface elements, each of said ramp elements defining a divided portion of said inclined plane, each of said ramp elements independently foldable against the side of said railing and said crib and independently extendable to said support surface.

17. The system of claim 1 wherein said ramp frame comprises a plurality of tubular components connected together by a plurality of joint components.

18. The system of claim 1 wherein said ramp surface comprises a fabric material stretched across and secured to said ramp frame.

19. The system of claim 18 wherein said fabric material comprises an open mesh fabric constructed of soft polyester fibers.

* * * * *

UNITED STATES PATENT AND TRADEMARK OFFICE

CERTIFICATE OF CORRECTION

PATENT NO. : 6,983,496 B1
APPLICATION NO. : 10/881026
DATED : January 10, 2006
INVENTOR(S) : Alfred Hernández It is certified that error appears in the above-identified patent and that said Letters Patent is hereby corrected as shown below:

Title Page, please add, (73) Assignee: and should read: -- (73) Encuenta Designs, L.L.C. --

Signed and Sealed this

Sixteenth Day of October, 2007

JON W. DUDAS
*Director of the United States Patent and Trademark Office*